US005945627A

United States Patent [19]

Arpin et al.

[11] Patent Number: 5,945,627

[45] Date of Patent: Aug. 31, 1999

[54] DETONATORS COMPRISING A HIGH ENERGY PYROTECHNIC

[75] Inventors: Jean-Luc Arpin, Longueuil; Réjean Aubé, Lachute, both of Canada; John A. Conkling, Chestertown, Md.

[73] Assignee: ICI Canada, Ontario, Canada

[21] Appl. No.: 08/718,169

[22] Filed: Sep. 19, 1996

[51] Int. Cl.[6] ..... C06C 5/04

[52] U.S. Cl. ..... 102/202.11; 102/202.12; 102/275.3; 102/275.6; 102/275.9; 102/275.11

[58] Field of Search ..... 102/202.11, 202.12, 102/275.3, 275.6, 275.9, 275.11; 149/37

[56] References Cited

U.S. PATENT DOCUMENTS

| | | | |
|---|---|---|---|
| 2,400,103 | 5/1946 | Cobb | 102/28 |
| 2,420,201 | 5/1947 | Seavey | 102/275.9 |
| 3,096,714 | 7/1963 | Yuill | 102/28 |
| 3,132,585 | 5/1964 | Higashishima et al. | 102/202.9 |
| 3,724,383 | 4/1973 | Gallaghan et al. | 102/28 |
| 3,933,543 | 1/1976 | Madden | 149/37 |
| 3,978,791 | 9/1976 | Lemley et al. | 102/28 |
| 4,047,987 | 9/1977 | Kusakabe et al. | 149/37 |
| 4,316,412 | 2/1982 | Dinegar et al. | 102/202.5 |
| 4,727,808 | 3/1988 | Wang et al. | 102/202.5 |
| 4,777,878 | 10/1988 | Johnson et al. | 102/202.5 |
| 5,035,756 | 7/1991 | Covino | 149/37 |
| 5,293,821 | 3/1994 | True et al. | 102/275.6 |
| 5,385,098 | 1/1995 | Lindqvist et al. | 102/205 |
| 5,404,813 | 4/1995 | Wong | 102/289 |
| 5,654,520 | 8/1997 | Boberg | 149/37 |

FOREIGN PATENT DOCUMENTS

| | | |
|---|---|---|
| 0 365 503 | 4/1990 | European Pat. Off. . |
| WO 97/22571 | 6/1997 | WIPO . |

*Primary Examiner*—Peter A. Nelson
*Attorney, Agent, or Firm*—Pillsbury Madison & Sutro, LLP

[57] ABSTRACT

In-hole and surface detonators are provided which are essentially free from primary explosives. The detonators utilize a high energy pyrotechnic mixture of a fuel and an oxidizer for initiation of a base charge enclosed in the detonator, or for the initiation of an adjacent shock tube. Improved safety during manufacture of detonators is achieved.

52 Claims, 4 Drawing Sheets

DETONATORS COMPRISING A HIGH ENERGY PYROTECHNIC

FIELD OF THE INVENTION

The present invention relates to explosive detonators comprising compositions which are characterized by being essentially free from molecular primary explosives, and in particular, free from lead azide.

DESCRIPTION OF THE RELATED ART

Detonators, including electronic, electric and non-electric types, are widely employed in mining, quarrying and other blasting operations. In-hole detonators are generally used to initiate an explosive charge which has been placed in a borehole, while surface detonators are generally used outside of the borehole to initiate one or more explosive initiating signal means such as shock tube or detonating cord.

Modern commercial detonators typically comprise, in the case of an in-hole detonator, a metallic shell closed at one end which shell contains, in sequence from the closed end, a base charge of a detonating, secondary explosive, such as for example, pentaerythritoltetranitrate (PETN) and an above adjacent, primer charge of a heat-sensitive, detonable, primary explosive, such as for example, lead azide. In a delay detonator, adjacent the primary explosive is an amount of a deflagrating or burning composition of sufficient quantity to provide a desired delay time. Above the delay composition (if present) is an electric match, a low energy detonating cord or shock wave conductor (such as shock tube), or the like, retained in the open end of the metallic shell.

Surface detonators are generally identical to in-hole detonators with the exception that the base charge of high explosive is preferably reduced or omitted to give lower output. The output is preferably reduced to a level sufficient to initiate adjacent shock tube, detonating cord and the like, without, for example, throwing excessive amounts of shrapnel which can damage nearby lengths of shock tube or cord. This feature of output control is a desirable practise in the design of detonators in order to control the energy output of in-hole and surface detonators.

For the purposes of this specification, a primary explosive is defined as an explosive substance which readily develops complete detonation from stimuli such as flame, conductive heating, impact, friction or static electrical discharge, even in the absence of any confinement. In contrast, a secondary explosive can be detonated only if present in larger quantities or if contained within heavy confinement such as a heavy walled metal container, or by being exposed to significant shock wave or mechanical impact. Examples of primary explosives are mercury fulminate, lead styphnate, lead azide and diazodinitrophenol (DDNP) or mixtures of two or more of these and/or similar substances. Representative examples of secondary explosives are (PETN), cyclotrimethylenetrinitramine (RDX), cyclotetramethylenetetranitramine (HMX), trinitrophenylmethylnitramine (Tetryl) and trinitrotoluene (TNT) or mixtures of two or more of these and/or other similar substances.

A large number of burning delay compositions, which are commonly slow burning, non-gas generating pyrotechnics comprising, for example, mixtures of fuels and oxidizers, are also known in the art. Similarly, a wide variety of base charge compositions are also known. However, the use of lead azide as a heat-sensitive, primary explosive material, or as the sole component of the base charge (in the case of some surface detonator type initiators), is standard practice in the detonator industry. Accordingly, lead azide is widely used by this industry.

The use of primary explosives in the preparation of surface and in-hole detonators, and in particular, the use of lead-containing materials such as lead azide, has several serious disadvantages. These include, for example,: (i) that even the presence of a small charge of primary explosive makes a conventional detonator potentially hazardous to handle because of its sensitivity to mechanical deformation or impact; (ii) that the manufacture of the detonator requires the production and handling of significant quantities of sensitive materials which require costly handling procedures; and (iii) that detonator manufacturing plants must address the health risks of dealing with potentially toxic materials such as lead, and address the proper disposal of these toxic materials.

Accordingly, due to the desirability of minimizing or eliminating the use of primary explosives during the production and use of detonators, for, inter alia, safety and/or toxicity reasons, it would be desirable to provide a detonator which was essentially free from primary explosives, and in particular, lead azide.

One approach to the elimination of primary explosives from detonators has been the development of primary explosive-free detonators which rely on the establishment of conditions in the detonator which will cause a secondary explosive to undergo a "deflagration to detonation transfer" (DDT). In these DDT detonators, a deflagration reaction is typically initiated in a secondary explosive by a thermal reaction with an igniting device, such as the flame front from a shock tube, or directly from a heated bridge wire. By suitable confinement of the secondary explosive, and/or control of the secondary explosive particle size, morphology, density, and formulation, as well as careful selection of the initiation means and detonator design, this deflagration reaction is caused to transfer to a detonation reaction which detonation provides sufficient force to initiate an adjacent base charge, or directly initiate a shock tube or length of detonating cord attached to the detonator. Examples of these types of DDT detonators are described in, for example, U.S. Pat. No. 4,727,808 (Wang et al.), U.S. Pat. No. 4,316,412 (Dinegar and Kirkham), and European Patent Application No. EP-A1-0,365,503 (Lindquist et al.) published Apr. 28, 1990.

A further discussion of this complex phenomena of DDT detonators is presented in "The Role of Particle Size and shape on the Propagation of Reaction in Explosive and pyrotechnic Formulations" by Austing, Tulis et al., Explosives Engineering, Vol. 13, No. 1, July/August 1995, pp.33–44). These document are all incorporated herein by reference.

While DDT detonators have shown promise for the replacement of standard primary explosive-containing detonators, their reliability and ease-of-manufacture have led to continued interest in developing additional types of primary explosives-free detonators.

These other primary explosives-free detonators have included devices such as "flyer" plates (U.S. Pat. No. 3,978,791) or involve the use of lasers (U.S. Pat. No. 3,724,383).

It should be noted, that the terms "deflagration", "detonation", "primary" explosive, and the like, are widely used in the explosives industry. However, due to possible variations in interpretation, the meaning of these terms is to be interpreted in accordance with the definitions provided in the above named Austing, Tulis et al. document.

Also contained in this document is a discussion of the classification of energetic materials as falling within three general classes. These include propellants, explosives, or pyrotechnics. For the purposes of the present specification, the definitions of these terms will also be as defined in the Austing et al. document. In particular, the definition of "pyrotechnic" will be used to describe a mixture of two powders; one being an elemental fuel and the other being an oxidizer compound. These pyrotechnics are generally used to create a special effect such as observed in matches, firework displays, decoy flares, illuminating flares, colour marker flares, obscuring smokes, and tracer ammunitions. The present definition is in contrast to European terminology wherein the term pyrotechnic is typically used to describe all energetic materials including propellants and explosives.

Furthermore, while pyrotechnics can, under certain circumstances, be detonated, their use has not traditional been for this purpose. In particular, their use for detonation in detonators has traditionally not been practised.

SUMMARY OF THE INVENTION

Accordingly, the present invention provides a detonator comprising:

(i) a hollow detonator shell having an open end and a closed end;

(ii) an igniting device at the open end of said shell;

(iii) optionally one or more delay elements adjacent said igniting device;

(iv) an initiation portion; and (v) optionally a base charge, characterized in that said initiation portion comprises a high energy pyrotechnic (HEP). More specifically, the HEP preferably comprises a mixture of at least two separate components, namely a fuel and an oxidizer.

The term "adjacent" when used in this specification means that two materials are located sufficiently close to one another that the reaction front passes from one material to the other. Contact between the materials is not required.

High energy pyrotechnics are preferably materials which are capable of generating a shock wave sufficiently large so that the initiation portion is able to preferably effect detonation of an adjacent base charge, shock tube or detonating cord. Preferred HEP materials are gas generating materials that can create a shock impulse, or incident pressure, of at least 100 MPa (1 kbar) and more preferably greater than 200 MPa (2 kbar).

It is also preferred that the HEP has a energy output rate which is at least 75% of the energy output of an equal weight of lead azide. Energy output can be measured by use of differential scanning calorimetry (DSC). Preferably, the energy output (in Joules/gram) of the initiation portion measured by DSC, is greater than the energy output of an equivalent amount of pure lead azide, and more preferably, is greater than 1.25 times the energy output of lead azide Most preferably, the energy output is greater than 1.5 times that of than lead azide.

It is also preferred that the HEP, and/or the initiation portion, have a velocity of detonation (VOD) of greater than 300 m/sec, and more preferably greater than 500 m/sec. More preferably, the HEP and/or initiation portion has a VOD of greater than 750 m/sec, and most preferably greater than 1000 m/sec.

Most, preferred are high energy pyrotechnics which are capable of providing both an energy output greater than that of lead azide, and having a VOD of greater than 500 m/sec. These pyrotechnics have been found to be particularly suitable for use in surface detonators.

Preferably, the initiation portion comprises at least 10% of said high energy pyrotechnic. More preferably, the initiation portion comprises at least 50%, and even more preferably, at least 90%, of said high energy pyrotechnic. Most preferably, however, the initiation portion comprises greater than 99% of said high energy pyrotechnic.

The detonator may be a "delay" detonator, by which term is meant that the detonator comprises means, such as a pyrotechnic delay element, a series of delay elements (e.g. a delay "train"), an electronic timing circuit, or some other device, to cause a time delay between initiation of the igniting device and the subsequent initiation of the initiation portion and/or base charge. However, the detonator may also be an instantaneous, non-delay detonator.

It should be emphasized that the pyrotechnic materials used to produce the delay elements or delay train in the prior art are typically not gas-generating, or produce very little gas during combustion. This is in distinct contrast to the high energy pyrotechnics of use in the present invention which are gas generating.

In a further aspect, the present invention also provides a process for the production of a detonator of the type described hereinabove with respect to the present invention, wherein the fuel and the oxidizer components of the initiation portion are combined immediately prior to addition to the detonator shell.

In a still further aspect, the present invention also provides a method of blasting comprising initiating an explosive charge using a detonator, wherein the detonator is as described hereinabove with respect to the present invention.

DESCRIPTION OF THE PREFERRED EMBODIMENTS

It is to be understood that all percentages given are given on a weight basis, and are based on the percentages of active ingredients. For example, the weight ratio of pyrotechnic (or fuel and oxidizer mixture) in the initiation portion is calculated based on ingredients which are either explosives, pyrotechnics or propellants. Accordingly, materials such as organic fuels, "inert" organic binders, and the like, which may or may not be consumed during the reaction/detonation, are excluded from the weight basis calculation.

Using this terminology, the initiation portion preferably comprises at least 10%, by weight, of the high energy pyrotechnic, as previously discussed. The remaining part of the initiation portion can be any suitable primary or secondary explosive which is added to modify the reaction characteristics of the initiation portion. This can include, for example, materials such as PETN or lead azide. However, in light of the stated goal of minimizing the use of a primary explosive, it is preferred that the initiation portion be essentially free of added primary explosives.

Preferably, the level of primary explosive is less than 25%, more preferably less than 10%, and most preferably, less than 1% of the initiation portion.

A preferred material which may be used in combination with the initiation portion is a material which is a "molecular" explosive. Preferred molecular explosives are generally secondary explosive compounds wherein the fuel and oxygen are present on the same molecule. Examples of preferred suitable secondary molecular explosives are PETN, RDX or HMX or mixtures thereof. The level of these secondary, molecular explosives is, however preferably less than 90% of the initiation portion, and more preferably, less than 50% of the initiation portion.

The amount of initiation portion present in an in-hole or a surface detonator can vary widely depending on its composition, detonator design, and desired output. The amount of high energy pyrotechnic present in the initiation portion can also vary. Generally, however, the level of high energy pyrotechnic for in-hole detonators is preferably between 10 and 200 mg, more preferably between 20 and 100 mg, and most preferably between 50 and 80 mg. For surface detonators, the level of high energy pyrotechnic present in the initiation portion is preferably between 100 and 500 mg, more preferably between 200 and 400 mg, and most preferably between 250 and 350 mg.

As previously stated, detonators of the present invention may be used in surface applications, which typically do not contain a base charge, as well as in in-hole detonators which typically do contain a base charge.

In an in-hole detonator, the base charge may be any of the materials described hereinabove with respect to prior art detonators. However, preferably the base charge used in the detonators of the present invention is a secondary explosive, and more preferably is a molecular secondary explosive.

Standard detonators known in the industry generally comprise a hollow, elongated cylindrical metal shell having one closed end. In the production of an in-hole detonator according to the present invention, the required weight of secondary explosive for the base charge, which is typically about 600 mg, is pressed into the closed end of the metal shell. The required weight of the initiation portion is loosely filled into the shell on top of the base charge and is compacted by pressing into the shell. The amount of base charge present will also vary depending desired features of the detonator. However, typical levels for the base charge in an in-hole detonator will range from 100 to 900 mg, and more preferably will be between 200 and 800 mg.

A delay element is optionally inserted above the initiation portion so that one end of the delay element is in proximity to the initiation portion. Manufacture of the delay element is a standard technique in the explosive detonator technology, and the delay element used in the present device can be manufactured using these techniques.

Adjacent the delay element is an igniting device. This igniting device can be any suitable device which will initiate the delay element and/or the initiation portion. Suitable igniting devices include electric "matches", bridge wires, shock tube, safety fuse, detonating cord, or the like, which are inserted into the open end of the detonator shell and which are capable of generating a flame and/or shock wave. The detonator shell is usually sealed, by crimping for example, around the igniting device or a suitable resilient sleeve.

Other devices which may be used as igniting devices include electronic detonator "hotspots", "slapper" detonators, lasers which are capable of generating an energy pulse through, for example, a fibre optic cable, and the like.

The initiation portion of the detonators of the present invention comprises a high energy pyrotechnic, which in the present specification, is a high energy mixture of a fuel and an oxidizer. Preferably, both of said fuel and said oxidizer are powdered materials at 20° C. Preferred pyrotechnics are those which provide relatively high energy output in comparison to standard fuel and oxidizer mixtures, in accordance with the energy output guidelines previously provided. It is therefore preferred to use these high energy pyrotechnics in order to ensure the initiation of the base charge in an in-hole detonator, or the initiation of an adjacent shock tube or detonating cord in the case of a surface detonator. A further benefit of using higher energy pyrotechnics is that the design of the detonator may be essentially the same as for prior art detonators with the exception of the replacement of the primary explosive.

High energy pyrotechnics having lower energy levels may also be used depending on the design of the remainder of the detonator. For example, the detonator might be adapted to increase confinement of the pyrotechnic in order to assist in the initiation of an adjacent base charge.

Initiation portions having lower energy, high energy pyrotechnics, may also be suitable for use in in-hole detonators or in non-delay type detonators, particularly in the situation where additional confinement of the initiation portion is provided. Without this additional confinement, however, it is desirable to provide an initiation portion having an energy output and VOD higher than the preferred minimum standards described hereinabove.

Not to be bound by theory, increased confinement is generally provided to keep the detonator shell intact longer so as to avoid the loss of pressure build-up within the detonator shell. The higher pressures are believed to assist in effecting increased energy output and/or VOD from the initiation portion.

The initiation portion, in an in-hole detonator may also comprise, a combination of a first portion of a high energy pyrotechnic, in series with a second portion of a low density molecular explosive. In this embodiment, the low density molecular explosive is initiated by the high energy pyrotechnic, and preferably, is subjected to increased confinement. Preferably, the molecular explosive is low density PETN having a density of less than the density of the base charge present in the same detonator.

The HEP portion of the initiation portion preferably comprises between 50 and 90%, by weight of an oxidizer, and between 10 to 50% by weight of a fuel. More preferably, the HEP comprises between 60 and 90% oxidizer and 10 to 40% fuel, and most preferably, the HEP comprises between 70 and 85% of oxidizer and between 15 and 30% by weight of fuel.

Preferred oxidizers are selected from the group consisting of alkali and alkaline earth metal nitrates, chlorates, perchlorates, peroxides and permanganates, ammonium nitrate, ammonium chlorates, ammonium perchlorate and mixtures thereof. It is particularly preferred that the oxidizer salt is a perchlorate or permanganate, and most preferably ammonium perchlorate, potassium perchlorate or potassium permanganate.

The particle size and shape-of the oxidizer can also influence the final properties of the initiation portion. Preferably, the oxidizers used in the practise of the present invention are dry powders at 20° C. and have a particle size of between 1 and 100 microns, more preferably between 10 and 80 microns, and most preferably between 20 and 40 microns.

Preferred fuels for the HEP portion of the initiation portion are selected from the group consisting of metallic fuels, including, aluminum, aluminum coated with a metal oxide such as iron oxide (available as "Aluminum Gold" from BASF), magnesium, "Magnalium" (a 50%/50% alloy of magnesium and aluminum), titanium, zirconium and the like. Most preferred metallic fuels are aluminum, magnalium or aluminum coated with iron oxide. (Aluminum Gold). As discussed with respect to the oxidizer component, the size and shape of the fuel component can affect the properties of the initiation portion. Preferably, the metallic fuel is a dry solid at 20° C. and has a median particle size of between 1 and 50 microns, more preferably between 2 and 30 microns, and most preferably between 3 and 10 microns.

A preferred formulation according to the present invention for use in both surface or in-hole detonators comprises a mixture of 70 to 90% of ammonium perchlorate having a median particle size of between 10 and 60 microns, and 10 to 30% of atomized aluminum powder with a median particle size of between 1 to 20 microns.

A second preferred formulation for in-hole detonators comprises a mixture of 50 to 70% potassium permanganate, 20 to 40% magnalium, and 5 to 20% sulfur.

If desired, other optional additional materials may be incorporated into the initiation portion. Examples of such materials include fuels such as finely divided solids including sulphur or carbonaceous materials such as gilsonite, comminuted coke or charcoal, carbon black, resin acids, sugars such as glucose or dextrose and other vegetable products such as starch, nut meal, grain meal and wood pulp; and mixtures thereof. Also materials such as propellants and/or gas-generating compounds such as nitrocellulose or sodium azide based propellants, and the like, may be added. Further, binders (preferably energetic binders) such as polymeric materials (including nitrocellulose or GAP (glycidyl azide polymer) can also be included.

Typically, the optional additional-fuel component comprises from 0 to 25% by weight of the initiation portion, and more preferably between 0 and 15% by weight of the initiation portion.

One feature of the initiation portion of the present invention is that the energy output and VOD, as well as other properties such as sensitivity, heat stability, and the like may be adjusted or modified by changes to the initiation portion formulations. Preferably, however, the initiation portion is formulated to provide acceptable performance standards over a wide temperature range from at least −40° C. to greater than 120° C.

An additional feature of the present invention is that the fuel and oxidizer components of the initiation portion are not primary explosives, and accordingly may be handled without the precautions necessary for handling primary explosives. Further, the two components of the initiation portion, in a preferred embodiment, do not form a pyrotechnic material until combined. In a preferred detonator production process, the two components of the initiation portion are not combined until immediately prior to adding the initiation portion to the detonator. By immediately prior is meant that the two components of the initiation portion are combined within 24 hours of addition to the detonator, and more preferably within 1 hour of addition to the detonator. More preferably, however, the two components are combined within 10 minutes of addition to the detonator. However, in a most preferred embodiment, the two components are combined immediately prior (e.g. less than 10 seconds) before addition to the detonator.

BRIEF DESCRIPTION OF THE DRAWINGS

The invention may be more clearly understood by reference to the accompanying drawings wherein:

With reference to FIG. 1*a*, a prior art delay detonator is shown wherein 1 designates a metal tubular shell closed at its bottom end and having a base charge of PETN 2 pressed or cast therein. 3 represents a primer charge of a heat sensitive material such as lead azide. A delay train of a mixture of red lead, silicon and barium sulphate is shown at 4 contained in a metal tube or carrier 5. Above delay train 4 is a electric match head 6 which is connected to a pair of electrically conducting leads 7. Leads 7 pass through a rubber insert 8 which insert is crimped into place by crimps 9 in shell 1.

Figure 1A:
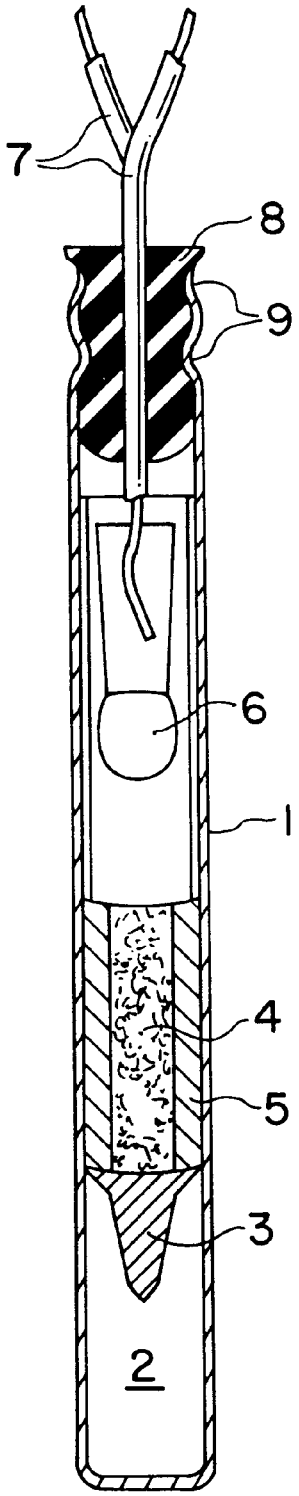
FIG. 1a (PRIOR ART)
FIG. 1*a* is a cross-sectional drawing of an electric, in-hole, delay detonator of the prior art.

In operation, an electrical signal passes through leads 7 and causes match head 6 to initiate. The initiation of match head 6 causes delay train 4 to begin burning at its upper end. Delay train 4 burns down to primer charge 3 which detonates, and effects the initiation of base charge 2.

Figure 1B:
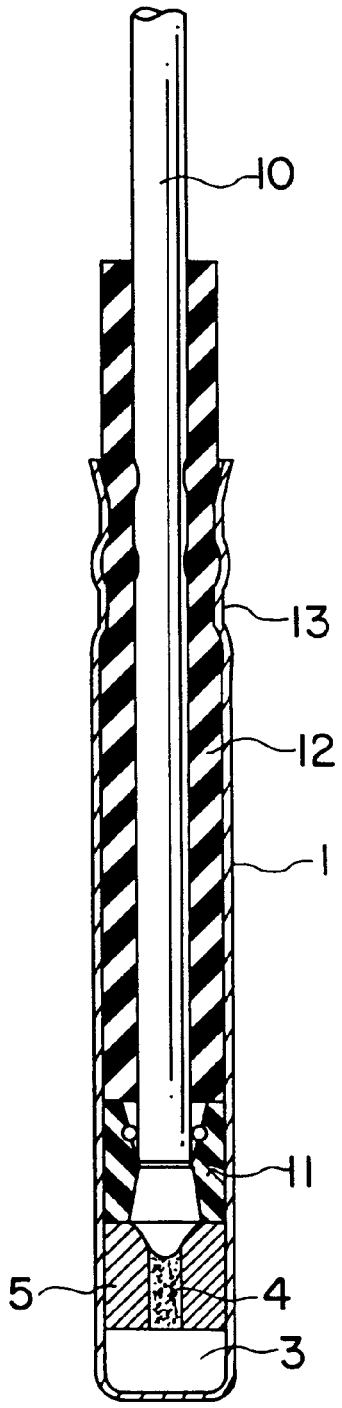
FIG. 1b (PRIOR ART)
FIG. 1*b* is a cross-sectional drawing of a non-electric, surface, delay detonator of the prior art.

In FIG. 1*b* a second delay detonator according to the prior art is shown. In this drawing, a non-electric surface detonator is shown wherein 1 designates a metal tubular shell closed at its bottom end. In this detonator, the base charge of FIG. 1*a* is omitted so that primer charge 3 rests at the bottom of tube 1. Above primer charge 3 is a delay train 4 contained in a metal tube or carrier 5. Above delay train 4 is the end of a length of inserted shock tube 10 which rests against an isolation cup 11. Shock tube 10 is held centrally and securely in tube 1 by means of closure plug 12 and crimp 13. When shock tube 10 is initiated at its remote end (not shown) a reaction front passes along the tube, through a diaphragm in isolation cup 11 and ignites delay charge 4. Delay charge 4 burns down to primer charge 3 which is caused to detonate.

Figure 2A:
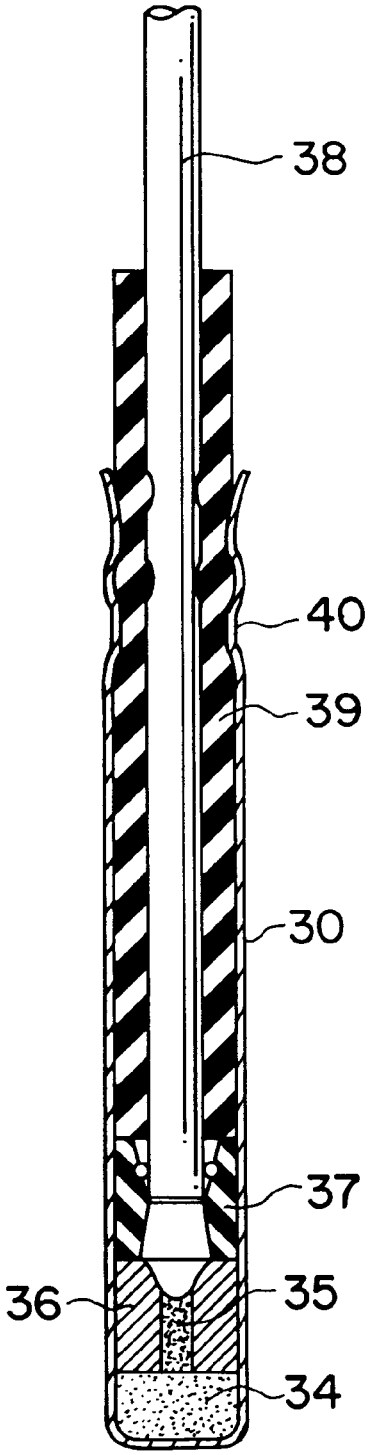
FIG. 2*a* is a cross-sectional drawing of an embodiment of a non-electric, surface, delay detonator, according to the present invention showing the position therein of the components of typical detonators according to the present invention.

With reference to FIG. 2*a*, a non-electric surface detonator is shown in accordance with the present invention. In FIG. 2*a*, a tubular metal shell 30 closed at its bottom end is shown containing a charge of 300 mg of a high energy pyrotechnic 34 (a mixture of 80% ammonium perchlorate (20 to 40 microns) and 20% atomized aluminum having a median particle size of 5.5 microns) which acts as an initiation portion in the present embodiment. Above initiation portion 34 is delay train 35 contained within a metal tube or carrier 36. Delay train 35 consists of a mixture of red lead, silicon and barium sulphate. Above delay train 35 is the end of a length of inserted shock tube 38 which rests against an isolation cup 37. Shock tube 38 is held centrally and securely in tube 30 by means of closure plug 39 and crimp 40.

Similar to the prior art system described in respect of FIG. 1*b*, when shock tube 38 is initiated at its remote end (not shown) a reaction front passes along the tube, through a diaphragm in isolation cup 37 and ignites delay charge 35. Delay charge 35 burns down to initiation portion 34 which is caused to detonate.

When correctly designed, the detonation of initiation portion 34 is preferably sufficient to initiate one or more shock tubes adjacent the detonator.

Figure 2B:
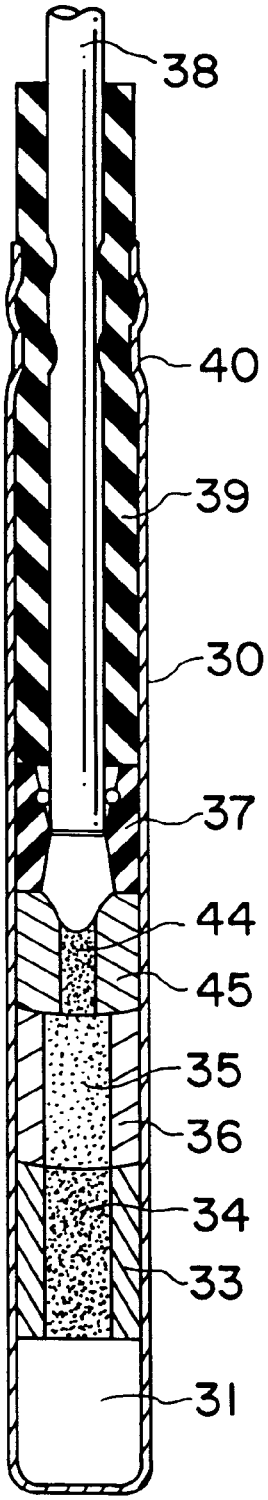
FIGS. 2*b* and 2*c* are cross-sectional drawings of embodiments of non-electric, in-hole delay detonators of the present invention.

FIG. 2*b* is a non-electric in-hole detonator according to the present invention. The features of this detonator are similar to the features of the detonator described in FIG. 2*a*. Accordingly, common components are represented by the same numbers. This embodiment, however, also comprises a base charge 31 of 780 mg of PETN. Above base charge 31 is a 150 mg charge of initiation portion 34 which has the same formulation as for FIG. 2*a*. Initiation portion 31 is contained with a steel confinement sleeve 33.

Also, above delay train 35 is a sealer element 44 of a red lead and silicon mixture held within a second metal tube 45. Above sealer element 44 is isolation cup 37 and shock tube 38.

In operation, this detonator is similar to the detonator of FIG. 2*a* except that the shock wave from shock tube 38 causes sealer element 44 to begin burning at its upper end. As it burns, sealer element 44 produces a slag which effectively seals the lower end of tube 30. This aids in creating additional confinement and thus, additional pressure within the detonator. Sealer element 44 burns down to delay train 35 which initiates and subsequently burns down to, and ignites, initiation portion 32. The initiation of initiation portion 34 creates a shock impulse sufficiently large (due to, inter alia, confinement sleeve 33) to cause base charge 31 to detonate.

Figure 2C:
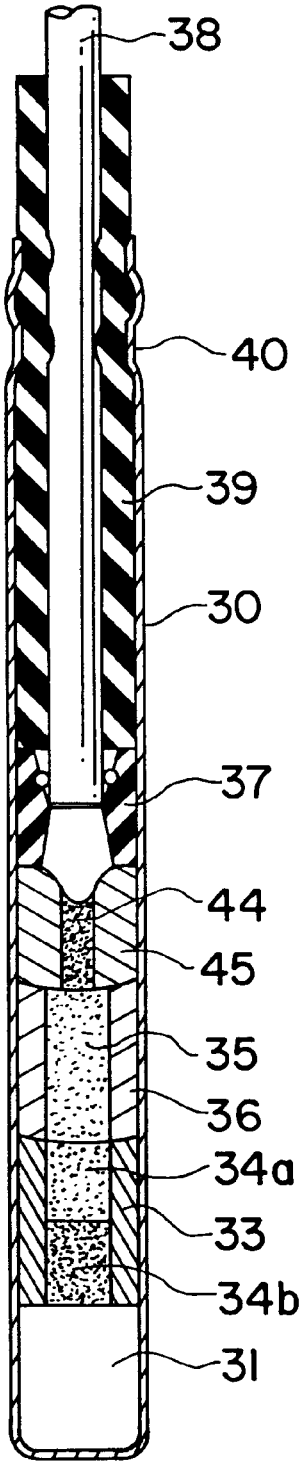

FIG. 2*c* shows an alternative design for an in-hole detonator similar to the detonator shown in FIG. 2*b*. Again, common components are given the same reference numbers.

In this embodiment, however, the initiation portion consists of two parts 34*a* and 34*b* in series. Component 34*a* is 50 mg of the same high energy pyrotechnic described in respect of FIG. 2*a*. Component 34*b* is a 110 mg charge of PETN having a lower density than the PETN of base charge 31. Both component 34*a* and 34*b* are contained within steel confinement sleeve 33.

This detonator is constructed by pressing 670 mg of base charge 31 into tube 30. The HEP charge 34*a* is pressed into sleeve 33. The remaining space in sleeve 33 is filled with PETN and pressed into place at a lower pressing pressure than that used to press base charge 31 into tube 30. Filled sleeve 33 is then inserted into tube 31.

Operation of this detonator is similar to the operation of the detonator shown in FIG. 2*b*. In this detonator, however, the delay train 35 causes the initiation of the first component 34*a* of the initiation portion. The initiation of first component 34*a* effects the initiation of second component 34*b* of the initiation portion. The initiation of second component 34*b* leads to the initiation of base charge 31.

Figure 3:
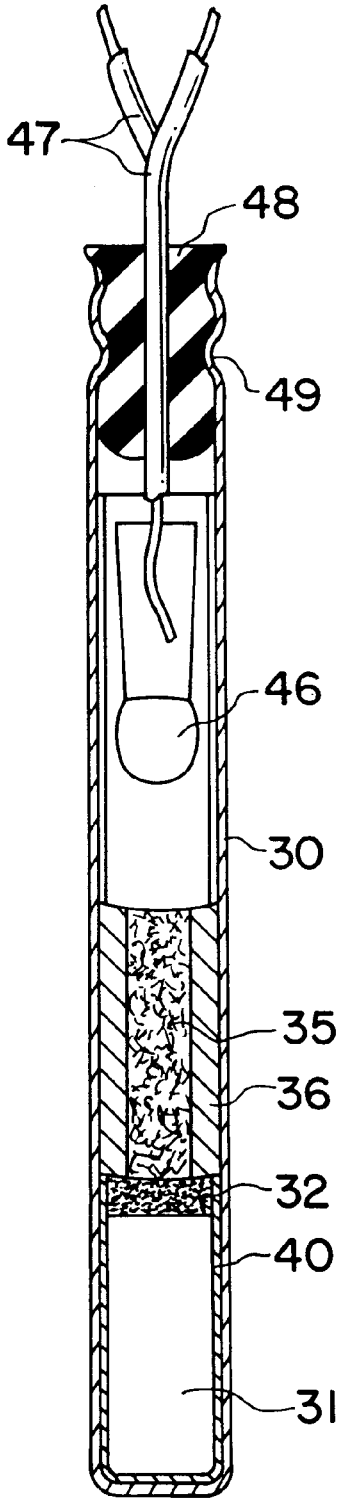
FIG. 3 is a cross-sectional drawing of one embodiment of an electric, in-hole delay detonator according to the present invention.

In FIG. 3, an electric in-hole detonator according to the present invention is shown. At the closed end of tube 30 is a copper cup 40 which contains a PETN base charge 31 and an initiation portion 32 which is a high energy pyrotechnic consisting of 20% atomized aluminum and 80% ammonium perchlorate. Above cup 40 is a delay train 35 held within a metal tube 36. Above delay train 35 is an electric match head 46 which is connected to a pair of electrically conducting leads 47. Leads 47 pass through a rubber insert 48 which insert is crimped into place by crimps 49 in shell 30.

In operation, an electrical signal passes through leads 47 and causes match head 46 to initiate. The initiation of match head 46 causes the initiation of delay train 35 which subsequently burns down to, and ignites, initiation portion 32. The initiation of initiation portion 32 then causes the initiation of base charge 31.

Figure 4:
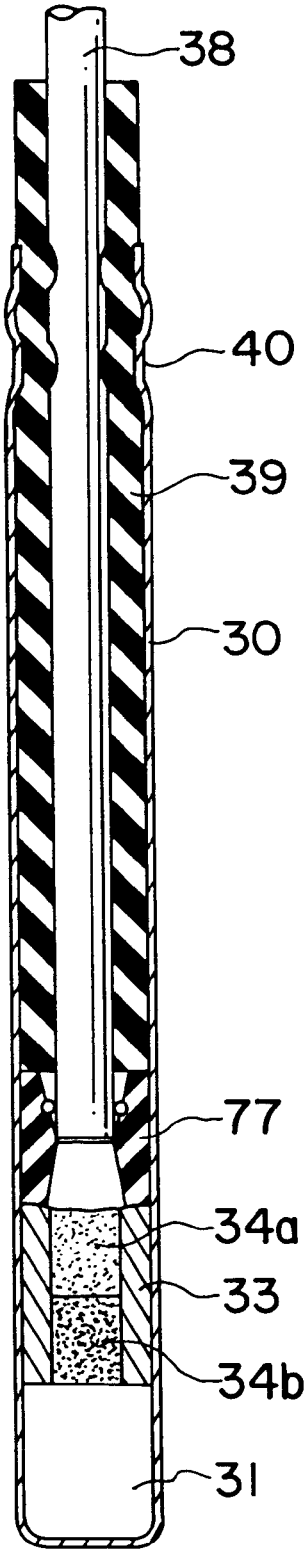
FIG. 4 is a cross-sectional drawing of an embodiment of a non-electric, instantaneous, in-hole detonator.

In FIG. 4, a non-electric, instantaneous in-hole detonator is shown having features similar to the detonators described hereinabove. However, in this embodiment, no delay element is present. Operation of this detonator is as described hereinabove with the exception that the shock wave from the shock tube directly initiates the initiation portion 34*a*.

Numerous variations and modifications of these devices are commonly known within the industry. For example, shock tubes or electric match heads can be replaced by a variety of devices which can effect initiation of the delay train, or instantaneous initiation of the initiation portion in a non-delay detonator. Further, the initiation portion can be directly initiated by a suitable device in an electronic detonator which eliminates the delay train in a delay detonator.

The utility of the invention will now be described, by way of example only, by reference to the following examples.

EXAMPLES

A series of detonators (both surface and in-hole types) were prepared using formulations according to the present invention. The detonators were tested for their ability to initiate an adjacent length of shock tube (for surface detonators) and for their ability to initiate an adjacent length of detonating cord (as a measure of their suitability for use in in-hole applications). Each detonator formulation was prepared in batches of 10 or more detonators, and the number of successful firings was noted.

It should be emphasised that all detonators initiated but not all were successful in initiating the adjacent shock tube or detonating cord. These "unsuccessful" designs can be improved to initiate shock tube by refinement of the selected formulation or by refinement of the detonator design, such as by providing additional confinement or the like.

A series of examples were studied and the examples and the test results are as follows. In all examples, surface detonators were prepared by inserting 300 mg of the selected formulation of the initiation portion into a standard detonator shell and pressing the formulation in place at a pressure of 2000 psi. In-hole detonators were prepared by inserting approximately 50 mg of the initiation portion into the upper area of a confinement sleeve. At the lower level of the confinement sleeve, was approximately 100 mg of PETN and pressed at 2000 psi. The confinement sleeve was placed in the detonator on top of a base charge which had been previously pressed into place at the bottom, closed end of the detonator shell.

All detonators tested were non-electric, and were initiated by the shock wave from an in-coming shock tube.

When appropriate, the effectiveness of a surface detonator was measured by its ability to initiate an adjacent length of shock tube. For these tests, the detonator was inserted into a commercially available connector block (available as a HANDIDET connector) into which were inserted 5 lengths of shock tube. The ability of the tested detonator to initiate the 5 lengths of shock tube was recorded.

Example 1

A mixture of 75% ammonium perchlorate and 25% of an iron oxide coated aluminum flake with a median particle size of 15 microns (available from BASF as "Aluminum Gold", grade L2020 containing approximately 35% iron oxide) was prepared, and used for testing of a series of surface detonators. A variety of particle sizes were compared for the ammonium perchlorate (AP).

TABLE 1

Surface Detonator Formulations

| AP Particle Size (Microns) | No. of Detonators Tested | No. of "Successful" Initiations (%)* |
|---|---|---|
| 0–20 | 4 | 0 |
| 20–40 | 4 | 70 |
| 0–40 | 4 | 30 |
| 40–75 | 4 | 65 |
| 0–75 | 4 | 30 |
| 75–200 | 4 | 0 |

*5 shock tubes adjacent each detonator

Example 2

Using a ammonium perchlorate particle size of 25 to 40 microns, and a variety of fuels, a series of surface detonators were prepared and tested. The level of the fuels was also varied.

TABLE 2

Surface Detonator Formulations

| Fuel | Particle Size (microns) | Fuel Level % | No. of Det. | Successful Initiation of shock tube (%)* |
|---|---|---|---|---|
| Atomized Aluminum | 5 | 10 | 5 | 76 |
| | | 15 | 5 | 100 |
| | | 20 | 20 | 100 |
| | | 25 | 5 | 100 |
| | 20 | 20 | 5 | 0 |
| | 30 | 20 | 5 | 0 |
| "Aluminum Gold" Flakes | 15 | 10 | 2 | 10 |
| | | 15 | 5 | 64 |
| | | 20 | 6 | 90 |
| | | 25 | 15 | 95 |
| | 20 | 20 | 5 | 96 |
| | | 25 | 5 | 76 |
| | | 35 | 3 | 20 |
| Aluminum Flakes (Paint Fine Grade) | 10 | 10 | 2 | 40 |
| | | 25 | 5 | 0 |
| | 15 | 15 | 5 | 88 |
| | | 20 | 5 | 0 |
| | | 25 | 5 | 0 |
| "Magnalium" (Magnesium & Aluminum alloy) | 34 | 10 | 2 | 40 |
| | | 20 | 5 | 76 |
| | 0–20 | 15 | 5 | 88 |
| | | 20 | 5 | 100 |
| | | 20 | 5 | 100 |
| | | 25 | 5 | 100 |
| | | 30 | 5 | 100 |

*5 shock tubes adjacent each detonator

Example 3

The effect of loading density (i.e. the pressure at which the initiation portion was pressed into the detonator shell) was also studied. In a standard formulation of 75% ammonium perchlorate with 25 to 40 micron particle size with 25% "Aluminum Gold" flakes with 15 micron median particle size, the following results were obtained.

TABLE 3

Surface Detonator Formulations

| Pressing Pressure (P.S.I.) | No. of Det. Tested | Successful Initiations of Shock Tube (%)* |
|---|---|---|
| 1000 | 5 | 92 |
| 2000 | 5 | 96 |
| 3000 | 5 | 96 |
| 4000 | 5 | 80 |
| 5000 | 5 | 76 |

*5 shock tubes adjacent each detonator

Example 4

A series of other surface detonator formulations were studied. The formulations and results are as shown below.

TABLE 4

Surface Detonator Formulations With: 25% Atomized Aluminum (5 microns)/75% Oxidizer (25 to 40 Microns)

| Oxidizer | No. of detonators | Successful Initiations of Shock Tube (%)* |
|---|---|---|
| Potassium Perchlorate | 5 | 52 |
| Barium Peroxide | 5 | 0 |
| Barium nitrate | 5 | 0 |
| Potassium Permanganate | 5 | 0 |

*5 shock tubes adjacent each detonator

Example 5

Dextrine was added to a mixture of 75% ammonium perchlorate (25 to 40 micron particle size) and 25% "Aluminum Gold" flakes (15 microns particle size), at levels of 5, 10, 15 and 25%. The dextrine acted as an organic fuel and/or as an "inert" binding agent. In the surface detonators tested, all successfully initiated an adjacent length of shock tube.

Example 6

Sulfur was added to a mixture of 75% ammonium perchlorate (25 to 40 micron particle size) and 25% "Aluminum Gold" flakes (15 microns particle size), at levels of 5 or 10%. In the surface detonators tested, all successfully initiated an adjacent length of shock tube.

Example 7

Using "Aluminum Gold" (Al—15 micron), ammonium perchlorate (AP—25 to 40 micron), sulfur (S), HMX and PETN, various formulations were prepared for testing in surface detonators. The formulations, and test results are as follows.

TABLE 5

Surface Detonator Formulations

| Formula | Ratio | No. of Det. | Successful Initiations of Shock Tube (%)* |
|---|---|---|---|
| Al/AP/HMX | 15/45/40 | 3 | 73 |
| Al/AP/PETN | 15/45/40 | 3 | 87 |
| Al/AP/HMX/S | 15/30/50/5 | 5 | 68 |
| Al/AP/PETN/S | 15/30/50/5 | 5 | 52 |

*5 shock tubes adjacent each detonator

A series of experiments were also conducted using a variety of detonators prepared for use as in-hole detonators. In order to assist in the initiation of adjacent detonating cord, all in-hole detonators were tested using confinement of the initiation portion of the detonator. The internal confinement sleeves were made of various materials and had an outside diameter of 6.6 mm and an inside diameter of 3.3 mm. The sleeves ranged from 20 to 29 mm in length, and were place in the detonator after the base charge had been pressed into place. External confinement sleeves were placed outside of the detonator.

With an internal confinement sleeve, only the upper portion of the confinement sleeve was filled with the initiation portion of the present invention. The remaining lower portion was filled with PETN. The amounts of the materials in the confinement sleeve are approximate since there is some variation in the amount of material loaded into the sleeve for each test.

Example 8

Detonators were prepared according to the following formulations and/or conditions.

1. In-hole Detonator with a formulation of 60% potassium permanganate, 30% magnalium and 10% sulfur.
   i. A 20 mm copper sleeve was placed on the outside of a detonator containing 800 mg of PETN as base charge and 150 mg of the initiation portion.
   ii. A 25 mm copper capsule (3.3 mm inside diameter) containing 800 mg of pressed PETN and 250 to 300 mg of initiation portion was placed into an aluminum detonator shell.
   iii. A 25 mm copper capsule (as in ii.) was placed into a copper detonator shell.
   iv. A 29 mm steel sleeve containing 450 mg of pressed PETN and 50 to 75 mg of initiation portion was placed into a regular aluminum detonator shell containing 400 mg of pressed PETN.
2. In-hole Detonator with a formulation of 50% potassium permanganate, 25% "Magnalium", 5% sulfur and 20% HMX.
   i. A 20 mm copper sleeve was placed on the outside of the detonator containing 800 mg of PETN as base charge and 150 mg of the initiation portion.

For all of experiments of 1 and 2, the initiation portion of the tested detonators successfully initiated the base charge (as indicated by a similar print on a "print" test when compared to a conventional detonator containing lead azide) but all failed to initiate an adjacent length of detonating cord.

3. In-hole Detonator with the following formulations of ammonium perchlorate, "Aluminum Gold" flakes and sulfur:
   i. 75/15/10%
   ii. 70/20/10%
   iii. 65/25/10%
   iv. 60/30/10%

Each of 3.i to 3.iv were placed in a 29 mm steel sleeve containing 450 mg of pressed PETN and 50 to 75 mg of initiation portion. The sleeve was then placed into an aluminum detonator shell containing 400 mg of pressed PETN.

4. In-hole Detonator with the formulation of 60% potassium permanganate, 30% "Aluminum Gold" flakes and 10% sulfur.

A 29 mm steel sleeve containing 450 mg of pressed PETN and 50 to 75 mg of initiation portion was place into an aluminum detonator shell containing 400 mg of pressed PETN.

5. In-hole Detonator with the formulation of 75% ammonium perchlorate and 25% "Aluminum Gold" flakes.

A 20 mm steel sleeve containing 275 mg of pressed PETN and 50 to 75 mg of initiation portion was place into an aluminum detonator shell containing 500 mg of pressed PETN.

6. In-hole Detonator with the formulation of 80% ammonium perchlorate and 20% atomized aluminum.

A 20 mm steel sleeve containing 275 mg of pressed PETN and 50 to 75 mg of initiation portion was place into an aluminum detonator shell containing 500 mg of pressed PETN.

All of the detonators prepared in accordance with formulations 3 to 6 successfully initiated the PETN base charge, and successfully initiated a attached length of detonating cord (e.g. CORDTEX—a trade mark of Imperial Chemical Industries PLC). Thus, the successful use of the initiation portion as described and claimed in the present application, for use in in-hole as well as for surface detonators, has been demonstrated.

Example 9

An in-hole detonator was prepared in an aluminum shell. The initiation portion consisted of 110 mg of HEP with a formulation of 80% ammonium perchlorate and 20% atomized aluminum which was inserted into a 14 mm long steel sleeve and pressed to a pressure of 2200 psi. Forty eight (48) mg of PETN was also inserted into the sleeve and also pressed to a pressure of 2200 psi. The HEP and "lower density" PETN, contained within the steel sleeve, were inserted into a detonator tube containing a pre-pressed charge of 740 mg of PETN which had bee pressed to a pressure of 3427 psi. When detonated, the detonator provided a good result in a "print" test.

Having described specific embodiments of the present invention, it will be understood that modifications thereof may be suggested to those skilled in the art, and it is intended to cover all such modifications as fall within the scope of the appended claims.

The embodiments of the invention in which an exclusive property or privilege is claimed are defined as follows:

1. A detonator comprising:

(i) a hollow detonator shell having an open end and a closed end;

(ii) an igniting device at the open end of said shell; and (iii) an initiation portion wherein said initiation portion consists essentially of a high energy pyrotechnic (HEP) which is a mixture of a fuel component and an oxidizer component.

2. A detonator as claimed in claim 1 wherein said initiation portion is subjected to additional confinement.

3. A detonator as claimed in claim 1 wherein said initiation portion comprises between 50 and 90%, by weight of an oxidizer, and between 10 to 50% by weight of a fuel.

4. A detonator as claimed in claim 3 wherein said initiation portion comprises between 60 and 90% oxidizer and 10 to 40% fuel.

5. A detonator as claimed in claim 3 wherein said initiation portion comprises between 70 and 85% of oxidizer and between 15 and 30% by weight of fuel.

6. A detonator as claimed in claim 2 wherein said oxidizer is selected from the group consisting of alkali and alkaline earth metal nitrates, chlorates, perchlorates, peroxides and permanganates, ammonium nitrate, ammonium chlorates, ammonium perchlorate and mixtures thereof.

7. A detonator as claimed in claim 6 wherein said oxidizer is a perchlorate or permanganate.

8. A detonator as claimed in claim 7 wherein said oxidizer is ammonium perchlorate, potassium perchlorate or potassium permanganate.

9. A detonator as claimed in claim 6 wherein said oxidizer is a dry powder at 20° C. and has a particle size of between 1 and 100 microns.

10. A detonator as claimed in claim 9 wherein said oxidizer has a particle size of between 10 and 80 microns.

11. A detonator as claimed in claim 9 wherein said oxidizer has a particle size of between 20 and 40 microns.

12. A detonator as claimed in claim 2 wherein said fuel is a metallic fuel.

13. A detonator as claimed in claim 12 wherein said metallic fuel is aluminum, aluminum coated with a metallic oxide, magnesium, titanium, zirconium or a 50%/50% alloy of magnesium and aluminum.

14. A detonator as claimed in claim 12 wherein said fuel is aluminum, aluminum coated with iron oxide, or a 50%/50% alloy of magnesium and aluminum.

15. A detonator as claimed in claim 12 wherein said fuel is a dry solid at 20° C. and has a particle size of between 1 and 50 microns.

16. A detonator as claimed in claim 15 wherein said fuel has a particle size of between 2 and 30 microns.

17. A detonator as claimed in claim 15 wherein said fuel has a particle size of between 3 and 10 microns.

18. A detonator as claimed in claim 2 wherein both of said oxidizer and said fuel do not form a pyrotechnic material until combined.

19. A detonator as claimed in claim 1 comprising a delay element adjacent said igniting device, so as to form a delay detonator.

20. A detonator as claimed in claim 1 wherein said initiation portion comprises at least 10%, by weight, of said pyrotechnic.

21. A detonator as claimed in claim 20 wherein said initiation portion comprises at least 50% of said pyrotechnic.

22. A detonator as claimed in claim 20 wherein said initiation portion comprises at least 90% of said pyrotechnic.

23. A detonator as claimed in claim 20 wherein said initiation portion comprises greater than 99% of said pyrotechnic.

24. A detonator as claimed in claim 1 which is essentially free of added primary explosives.

25. A detonator as claimed in claim 1 wherein said initiation portion comprises up to 90%, by weight, of a primary or secondary molecular explosive.

26. A detonator as claimed in claim 25 wherein said primary or secondary explosive is PETN, RDX, HMX, Tetryl, TNT, lead azide, lead styphnate, mercury fulminate or diazodinitrophenol, or combinations thereof.

27. A detonator as claimed in claim 1 wherein said initiation portion comprises additional components selected from the group consisting of explosives, propellants, organic fuels, and binders and combinations thereof.

28. A detonator as claimed in claim 1 wherein said initiation portion comprises additional fuel materials.

29. A detonator as claimed in claim 28 wherein said additional fuel materials are gilsonite, comminuted coke or charcoal, carbon black, glucose or dextrose, starch, nut meal, grain meal or wood pulp or mixtures thereof.

30. A detonator as claimed in claim 28 wherein said initiation portion comprises up 0 to 25% by weight of said additional fuel materials.

31. A detonator as claimed in claim 28 wherein said initiation portion comprises up to 0 and 15% by weight of said additional fuel materials.

32. A detonator as claimed in claim 1 wherein said initiator portion additionally comprises sulfur.

33. A detonator as claimed in claim 32 wherein said initiation portion comprises up to 0 and 10%, by weight of sulphur.

34. An in-hole detonator comprising:

(i) a hollow detonator shell having an open end and a closed end;

(ii) an igniting device at the open end of said shell;

(iii) a delay element adjacent said igniting device;

(iv) an initiation portion adjacent said delay element or said igniting device; and (v) a base charge adjacent said initiation portion, wherein said initiation portion consists essentially of a high energy pyrotechnic which is a mixture of a fuel component and an oxidizer component.

35. An in-hole detonator as claimed in claim 34 wherein said base charge is a secondary explosive.

36. An in-hole detonator as claimed in claim 34 wherein said base charge is a molecular explosive.

37. An in-hole detonator as claimed in claim 34 wherein said base charge is PETN or RDX.

38. An in-hole detonator as claimed in claim 34 which comprises a base charge of between 100 to 900 mg.

39. An in-hole detonator as claimed in claim 38 which comprises a base charge of between 200 and 800 mg.

40. An in-hole detonator as claimed in claim 34 wherein said initiation portion comprises a mixture of 70 to 90% of ammonium perchlorate having a median particle size of between 15 and 60 microns, and 10 to 30% of atomized aluminum powder with a median particle size of between 1 to 20 microns.

41. An in-hole detonator as claimed in claim 34 wherein said initiation portion comprises a mixture of 50 to 70% potassium permanganate, 20 to 40% of a 50%/50% alloy of magnesium and aluminum, and 5 to 20% sulfur.

42. An in-hole detonator as claimed in claim 34 wherein said initiation portion comprises, in series, a first portion of a high energy pyrotechnic, and a second portion of a molecular explosive.

43. An in-hole detonator as claimed in claim 42 wherein said molecular explosive is low density PETN.

44. An in-hole detonator as claimed in claim 42 wherein said initiation portion is subjected to increased confinement.

45. A surface detonator comprising:

(i) a hollow detonator shell having an open end and a closed end;

(ii) an igniting device at the open end of said shell;

(iii) a delay element adjacent said igniting device; and (iv) an initiation portion adjacent said delay element or said igniting device;

wherein said initiation portion consists essentially of a high energy pyrotechnic which is a mixture of a fuel component and an oxidizer component.

46. A surface detonator as claimed in claim 45 wherein said initiation portion comprises a mixture of 70 to 90% of ammonium perchlorate having a median particle size of between 10 and 60 microns, and 10 to 30% of atomized aluminum powder with a median particle size of between 1 to 20 microns.

47. A surface detonator as claimed in claim 45 wherein said initiation portion comprises between 200 and 400 mg of said high energy pyrotechnic.

48. A surface detonator as claimed in claim 47 wherein said initiation portion comprises between 250 and 350 mg of said high energy pyrotechnic.

49. A detonator as claimed in claim 1 wherein said igniting device is a flame and/or shock wave from an electric match, a bridge wire, a shock tube, or a detonating cord which is inserted into the open end of the detonator shell.

50. A detonator as claimed in claim 1 wherein said detonator is an electronic detonator.

51. A detonator as claimed in claim 1 wherein said high energy pyrotechnic has an energy output, as measured by differential scanning calorimetry, equal to at least 75% of the energy output of lead azide, and a velocity of detonation of at least 300 m/sec.

52. A detonator as claimed in claim 1 wherein said high energy pyrotechnic has an incident pressure of at least 100 MPa.

* * * * *